US010132603B2

(12) United States Patent
Kennedy

(10) Patent No.: US 10,132,603 B2
(45) Date of Patent: Nov. 20, 2018

(54) PROJECTILE DEVICE FIRED IN A FLIGHT TRAJECTORY TOWARDS A TARGET

(71) Applicant: Darren J Kennedy, Beloit, WI (US)

(72) Inventor: Darren J Kennedy, Beloit, WI (US)

(73) Assignee: Darren J. Kennedy, Beloit, WI (US)

( * ) Notice: Subject to any disclaimer, the term of this patent is extended or adjusted under 35 U.S.C. 154(b) by 0 days.

(21) Appl. No.: 15/390,354

(22) Filed: Dec. 23, 2016

(65) Prior Publication Data

US 2018/0180392 A1 Jun. 28, 2018

(51) Int. Cl.

| | |
|---|---|
| ***F42B 10/34*** | (2006.01) |
| ***F42B 12/56*** | (2006.01) |
| ***F42B 5/02*** | (2006.01) |
| ***F42B 7/08*** | (2006.01) |

(52) U.S. Cl.

CPC ..... *F42B 12/56* (2013.01); *F42B 5/02* (2013.01); *F42B 7/08* (2013.01); *F42B 10/34* (2013.01)

(58) Field of Classification Search

CPC ..... F42B 10/34; F42B 10/36; F42B 12/56
USPC ..... 102/439, 503, 501, 391, 520, 382; 473/577

See application file for complete search history.

(56) References Cited

U.S. PATENT DOCUMENTS 1,899,618 A * 2/1933 Holthe ..... F42B 10/34 102/439
2,433,334 A * 12/1947 Birkeland ..... F42B 10/34 102/439
3,561,363 A * 2/1971 Birkigt ..... F42B 10/34 102/380
4,301,736 A * 11/1981 Flatau ..... F42B 10/34 102/501
5,275,110 A * 1/1994 Flatau ..... F42B 30/02 102/503
5,465,980 A * 11/1995 Maurin ..... F41H 13/0006 473/575
5,515,787 A * 5/1996 Middleton ..... F42B 7/10 102/439
6,238,310 B1 * 5/2001 Morrison ..... F42B 6/04 473/581
8,844,443 B2 * 9/2014 Tomov ..... F42B 10/30 102/490
8,960,094 B1 * 2/2015 Calvert ..... F42B 12/34 102/371
9,383,177 B1 * 7/2016 Kallmes ..... F42B 10/02
2010/0137080 A1 * 6/2010 Cyr ..... F42B 6/04 473/575
2012/0291651 A1 * 11/2012 Haumann ..... F42B 12/06 102/384
2014/0331883 A1 * 11/2014 Miller ..... F42B 5/02 102/439
2016/0010964 A1 * 1/2016 Langenbeck ..... F42B 7/08 102/503
2016/0216092 A1 * 7/2016 Langenbeck ..... F42B 10/34

* cited by examiner

*Primary Examiner* — Reginald S Tillman, Jr.

(57) ABSTRACT

A projectile device is disclosed for firing at a target. The projectile device includes a shroud, the shroud having a forward end and a rearward end. The shroud defines a channel which extends through the shroud between the forward end and the rearward end of the shroud. An insert is releasably secured to the shroud such that after the forward end of the shroud strikes the target, the insert is released from the shroud for increasing penetration of the shroud through the target.

11 Claims, 11 Drawing Sheets

PROJECTILE DEVICE FIRED IN A FLIGHT TRAJECTORY TOWARDS A TARGET

BACKGROUND OF THE INVENTION

Field of the Invention

The present invention relates to a projectile device fired in a flight trajectory towards a target.

More specifically, the present invention relates to a projectile device fired in a flight trajectory towards and into a target with increased penetration.

Background Information

In hunting, the ability to shoot a target with increased penetration is clearly advantageous. In the prior art, many different projectiles have been disclosed so that the animal being hunted is successfully hit by the projectile.

However, a problem exists in that many of the aforementioned projectiles do not have sufficient momentum on impact to effectively bring the animal down. Particularly, in bear hunting, a projectile will often strike the target without penetrating any vital organs. For obvious reasons, this poses a serious and potentially life threatening situations for the hunter as the wounded animal may survive the shot and turn on the hunter. Preferably, the projectile will strike the target with sufficient momentum to actually pass right through the animal so that if the animal does not immediately fall, an easily followed blood trail is provided. More specifically, a blood trail is left from both the point of entry and the point of exit of the projectile. Such trail enables the hunter to easily locate the wounded animal.

The present invention relates to a unique projectile which enables the projectile to strike the target with more momentum and with greater penetration and cutting power for rapidly disabling the hunted animal.

Therefore, a primary object of the present invention is the provision of a projectile device having an improved penetrating capability.

Another objective of the present invention is the provision of a projectile having an increased momentum on striking a target so that the projectile is able to penetrate and cut through the target.

Yet another object of the present invention is the provision of a projectile device having an increased ability to rapidly and effectively disable an animal being hunted.

A further object of the present invention is the provision of a projectile device having an increased ability to render the hunted animal harmless to the hunter.

Other features and advantages of the present invention will be readily apparent to those skilled in the art by a consideration of the detailed description of a preferred embodiment of the present invention contained herein.

SUMMARY OF THE INVENTION

The present invention relates to a projectile device for firing at a target. The projectile device includes a shroud, the shroud having a forward end and a rearward end. The shroud defines a channel which extends through the shroud between the forward end and the rearward end of the shroud. An insert is releasably secured to the shroud such that after the forward end of the shroud strikes the target, the insert is released from the shroud for increasing penetration of the shroud through the target.

In a more specific embodiment, the present invention relates to a projectile device fired in a flight trajectory towards a target. The projectile device includes a shroud of generally cylindrical configuration. The shroud has a forward end and a rearward end, the shroud defining a channel which extends through the shroud between the forward end and the rearward end of the shroud. An insert is releasably secured relative to the rearward end of the shroud such that during movement along the flight trajectory towards the target, a flow of air flowing through the forward end of the shroud through the channel is restricted by the insert. The arrangement is such that when the projectile device is fired, the combined shroud and insert are secured relative to each other such that when the forward end of the shroud strikes the target, forward momentum of the shroud causes the forward end of the shroud to cut a column from the target. The arrangement is such that the column flows through the channel from the forward end of the shroud towards the insert. When the column of the target contacts the insert, the leading edge of the column urges the insert to release from the rearward end of the shroud for permitting further cutting of the column by the forward end of the shroud. The arrangement is such that the column progressively flows through the channel for increasing penetration of the shroud through the target.

In a preferred embodiment of the present invention, the shroud is fabricated from metal. More particularly, the shroud further includes an internal wall which defines the channel.

Also, a web extends inwardly from the internal wall of the shroud and a flighted member is rigidly secured to and defined by the web such that when the projectile hits the target, the flighted member cooperates with the target so that the projectile rotates and cuts through the target. More specifically, rotation of the shroud on impact enables cutting of the column from the target so that penetration of the shroud through the target is further enhanced.

The insert is fabricated from a plastics material and includes a forward portion for insertion within the rearward end of the shroud so that the insert is releasably secured to the shroud.

Additionally, a rearward portion of the insert has a diameter which is substantially the same as an outer diameter of the shroud.

In one embodiment of the present invention, the shroud is intended for firing from a smooth bore rifle.

In another embodiment of the present invention, the shroud is intended for firing from a rifled bore.

The projectile device also includes a wad fabricated from a plastics material. The wad has a base of circular configuration, the base defining a circumferential edge. A detonator is located centrally on the base and an upstanding wall extends from the circumferential edge of the base.

Furthermore, the upstanding wall, the base and the insert define a chamber for the reception therein of explosive propellant, the chamber being disposed adjacent to the detonator.

Also, the upstanding wall further defines an enclosure for the reception therein of the insert and the shroud such that the chamber is disposed between the detonator and the enclosure. The arrangement is such that when the detonator is detonated, the explosive propellant within the chamber is ignited for propelling the combined insert and shroud along the flight trajectory towards the target.

The flight trajectory, in the absence of any cross-wind, lies in a plane extending centrally along a bore of a rifle and the target so that during flight of the projectile towards the target, the restriction of the flow of air by the insert inhibits any generation of random circumferentially spaced eddies that could otherwise cause the shroud to deviate from the plane of the flight trajectory. The arrangement is such that extreme accuracy of movement of the projectile device during the flight of the projectile is achieved.

Many modifications and variations of the present invention will be readily apparent to those skilled in the art by a consideration of the detailed description contained hereinafter taken in conjunction with the annexed drawings which show a preferred embodiment of the present invention. However, such modifications and variations fall within the spirit and scope of the present invention as defined by the appended claims.

Included in such modifications would be the application of the concept of this invention to a bullet fired from a pistol or the like. Also, the forward end of the shroud may be formed as a chisel edge or cutting edge or provided with serrations to further enhance penetration of the shroud through the target.

BRIEF DESCRIPTION OF THE DRAWINGS

Similar reference characters refer to similar parts throughout the various views of the drawings.

DETAILED DESCRIPTION OF THE DRAWINGS

Figure 1:
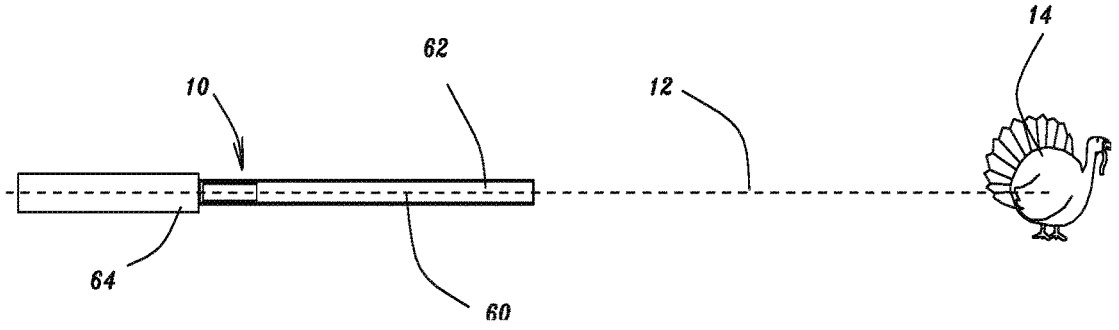
FIG. 1 is a side elevational view of a projectile device according to the present invention fired in a flight trajectory towards a target.

FIG. 1 is a side elevational view of a projectile device generally designated 10 according to the present invention fired in a flight trajectory 12 towards a target 14.

Figure 2:
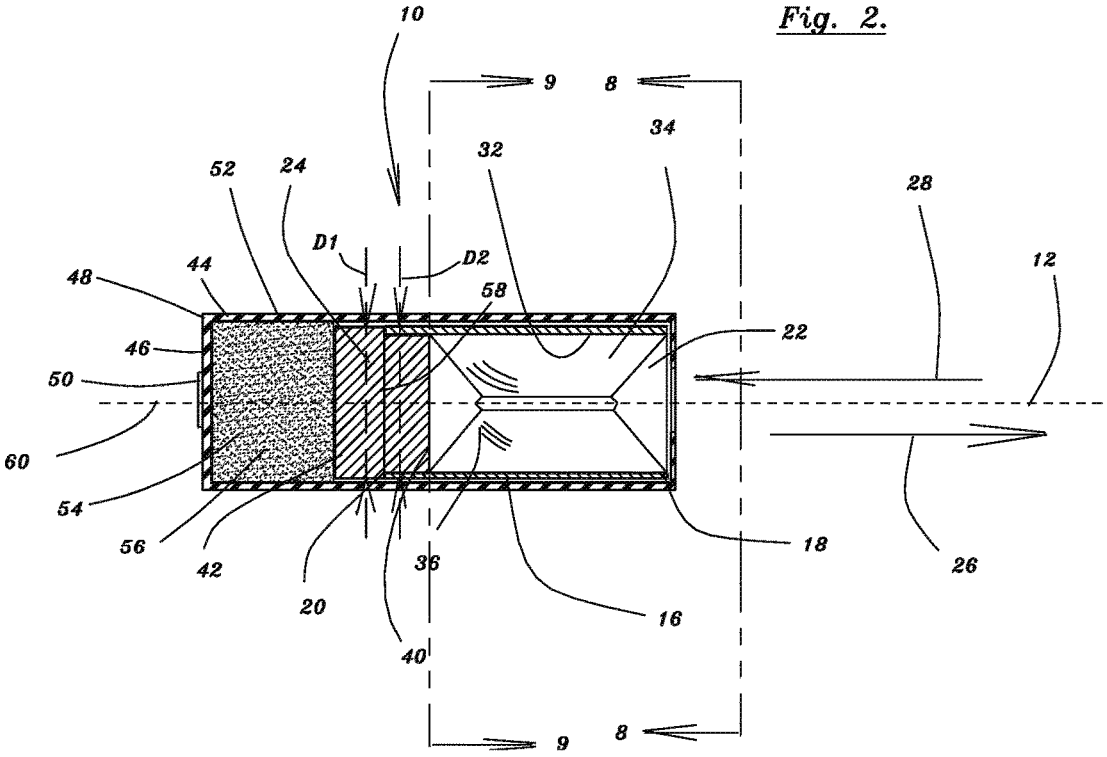
FIG. 2 is an enlarged side elevational view of the projectile device shown in FIG. 1.

FIG. 2 is an enlarged side elevational view of the projectile device 10 shown in FIG. 1. As shown in FIG. 2, the projectile device 10 includes a shroud 16 of generally cylindrical configuration. The shroud 16 has a forward end 18 and a rearward end 20. The shroud 16 defines a channel 22 which extends through the shroud 16 between the forward end 18 and the rearward end 20 of the shroud 16. An insert 24 is releasably secured relative to the rearward end 20 of the shroud 16.

Figure 2A:
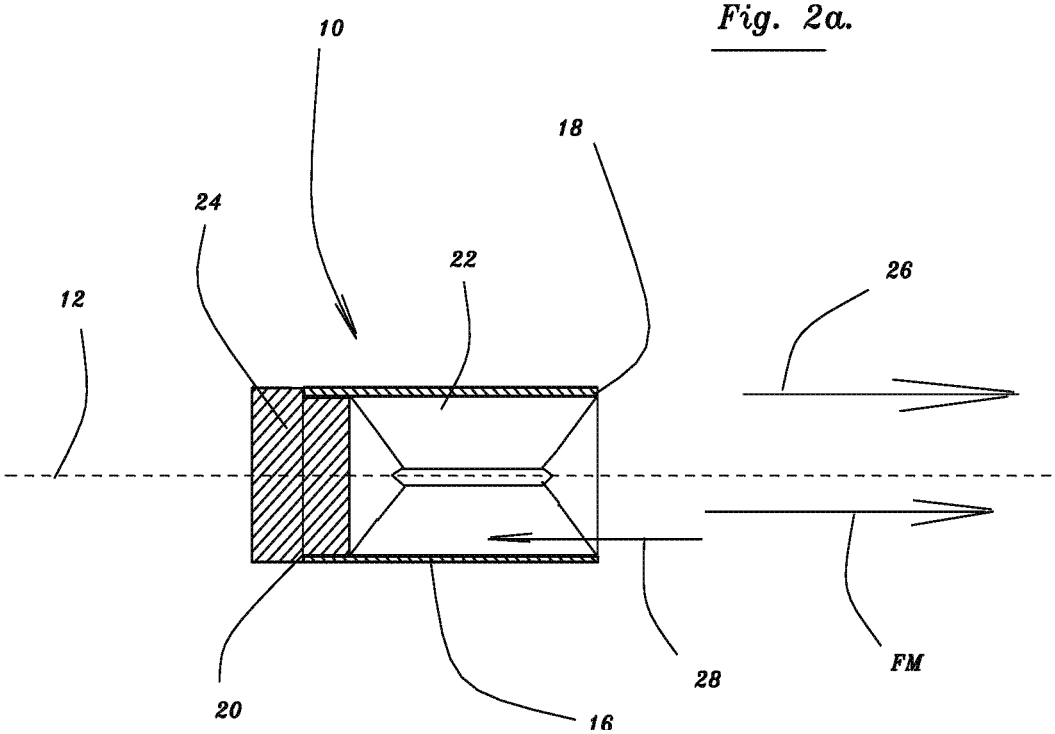
FIG. 2*a* is a similar view to that shown in FIG. 2 but shows the shroud and attached insert in flight.

FIG. 2*a* is a similar view to that shown in FIG. 2 but shows the shroud 16 and attached insert 24 in flight the casing 52 shown in FIG. 1 having separated from the combined shroud 16 and insert 24 soon after exit of the projectile device 10 from muzzle or bore 62 of the rifle 64.

As shown in FIG. 2*a*, during movement of the projectile device 10 as indicated by the arrow 26 along the flight trajectory 12 towards the target 14 (shown in FIG. 1), a flow of air as indicated by the arrow 28 flowing through the forward end 18 of the shroud 16 through the channel 22 is restricted by the insert 24 during movement of the projectile device 10 along the flight trajectory 12 towards the target 14.

Figure 2B:
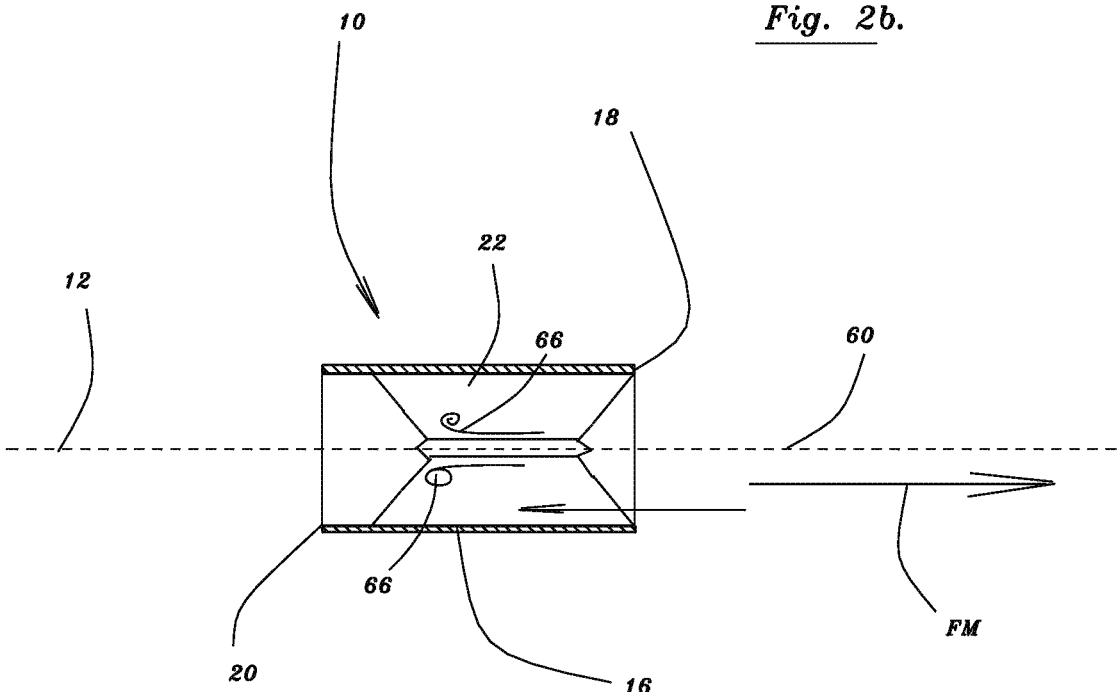
FIG. 2*b* is a similar view to that shown in FIG. 2*a* but shows a projectile device and the detrimental effect thereon of removing the insert.

FIG. 2*b* is a similar view to that shown in FIG. 2*a* but shows a projectile device in flight but having the insert 24 removed therefrom. In the arrangement shown in FIG. 2*b*, the free flow of air 28 could and would result in the detrimental generation of randomly disposed eddies 66 within the channel 22 that would have the effect of deviating the projectile device 10 from the desired course along the trajectory 12.

As shown in FIG. 2*a*, the arrangement is such that when the projectile device 10 is fired, the shroud 16 and the insert 24 are secured relative to each other.

Figure 3:
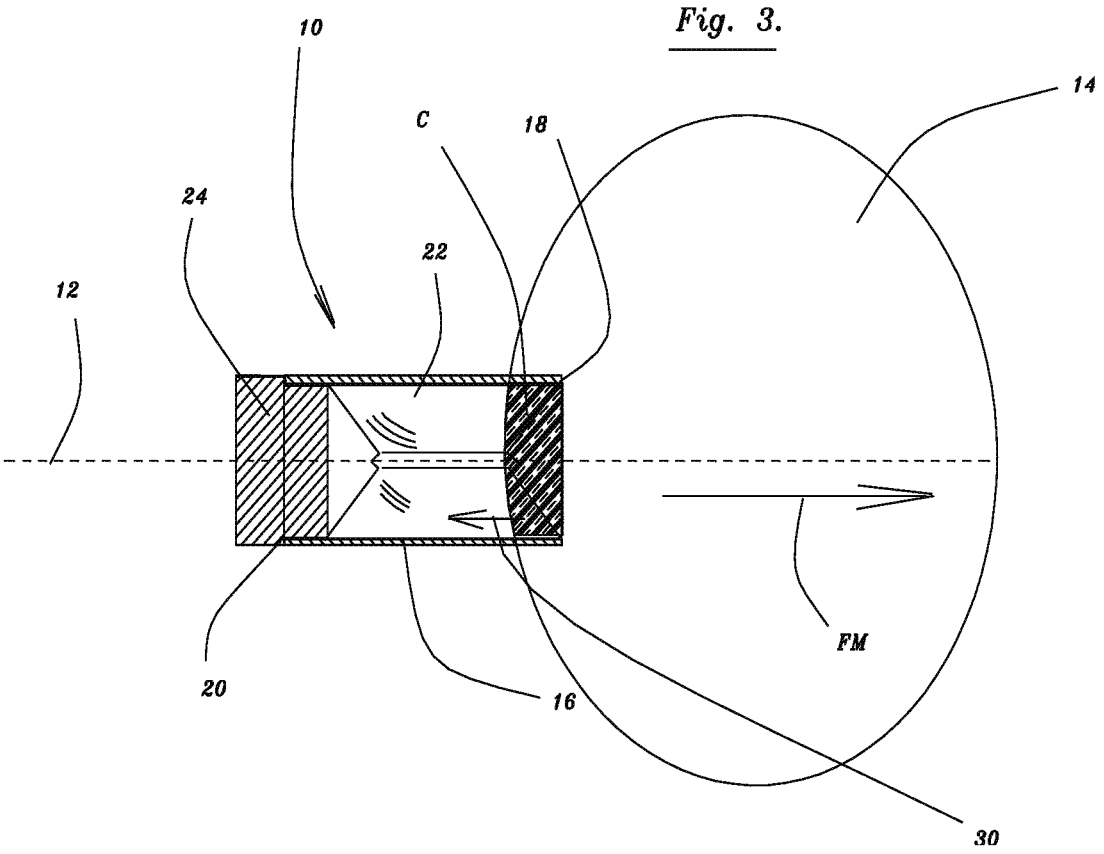
FIG. 3 is a similar view to that shown in FIG. 2*a* but shows the projectile device hitting the target.

FIG. 3 is a similar view to that shown in FIG. 2*a* but shows the projectile device 10 hitting the target 14. As shown in FIG. 3, when the forward end 18 of the shroud 16 strikes the target 14, forward momentum of the shroud 16 as indicated by the arrow FM causes the forward end 18 of the shroud 16 to progressively cut a column C from the target 14. The arrangement is such that the column C flows as indicated by the arrow 30 through the channel 22 from the forward end 18 of the shroud 16 towards the insert 24.

Figure 4:
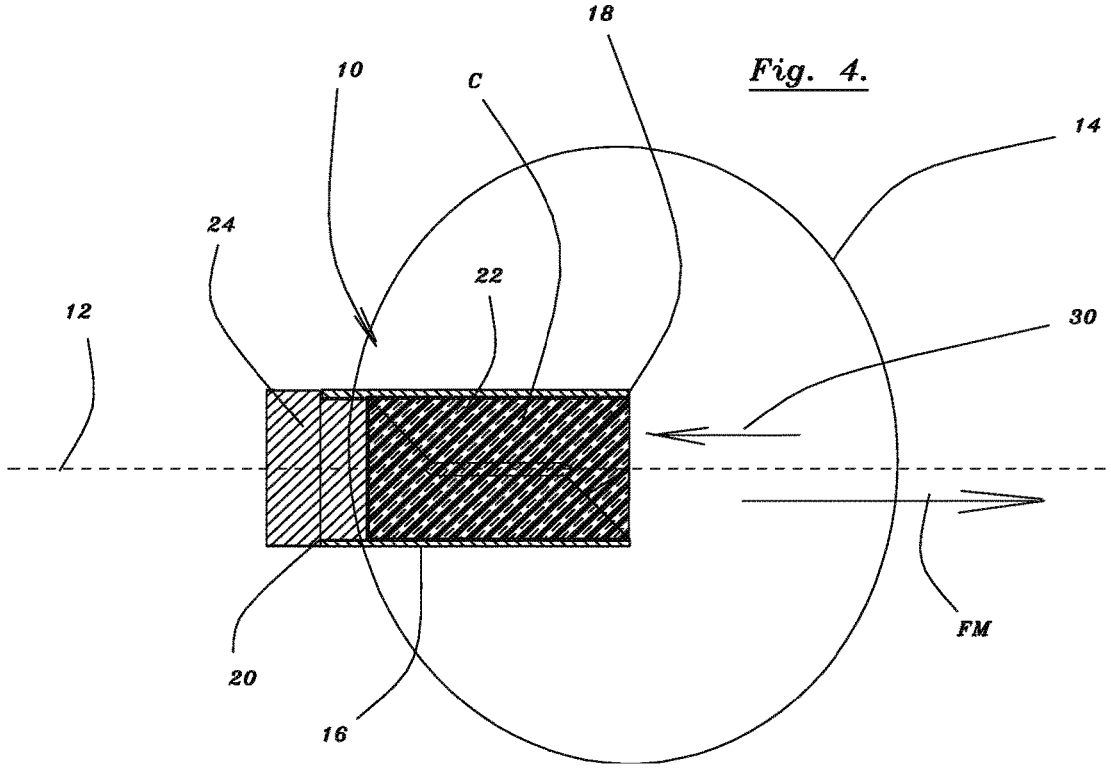
FIG. 4 is a similar view to that shown in FIG. 3 but shows the shroud having penetrated partially through the target.

FIG. 4 is a similar view to that shown in FIG. 3 but shows the shroud 16 having penetrated partially through the target 14. As shown in FIG. 4, when the column C of the target 14 contacts the insert 24, the column C urges the insert 24 to release from the rearward end 20 of the shroud 16 for permitting further cutting of the column C by the forward end 18 of the shroud 16. The arrangement is such that the column C progressively flows as indicated by the arrow 30 through the channel 22 for increasing penetration of the shroud 16 through the target 14.

Preferably, the shroud 16 is fabricated from metal. As shown in FIG. 2, the shroud 16 further includes an internal wall 32 which defines the channel 22.

Also, a web 34 extends inwardly from the internal wall 32 and a flighted member 36 is rigidly secured to and is defined by the web 34 such that during movement of the projectile device 10 along the flight trajectory 12 towards the target 14, the flighted member 36 cooperates with the target on impact so that the vanes V1, V2 and V3 or flights of the flighted member 36 cause the shroud 16 and the forward end 18 thereof to rotate and cut through the target. More specifically, the arrangement is such that the flighted member 36 is rotated axially upon striking the target. The arrangement is such that the web 34 and shroud 16 are correspondingly rotated for increasing the penetration of the target. For emphasis, rotation of the shroud 16 as indicated by the arrow 38 shown in FIG. 8 further enhances cutting of the column C from the target 14 so that penetration of the shroud 16 through the target 14 achieved. Also, when the projectile device is fired from a rifle having a rifled barrel, the spin of the projectile device 10 generated by the rifling is further enhanced on impact with the target by the vanes V1, V2 and V3 so that the shroud 16 easily cuts through the target 14. Consequently, the vanes V1 to V3 are disposed in the same direction of orientation as the rifling. Also, the vanes V1 to V3 defined by the web 34 are arranged such that they generate the same direction of rotation 38 on impact regardless of the disposition of the shroud 16 within the wad 44 to be described hereinafter.

As shown in FIG. 2, the insert 24 is fabricated from a plastics material and includes a forward portion 40 for removable insertion thereof within the rearward end 20 of the shroud 16 for releasably securing the insert 24 to the shroud 16

Additionally, a rearward portion 42 of the insert 24 has a diameter D1 which is substantially the same as an outer diameter D2 of the shroud 16.

In one embodiment of the present invention, the shroud 16 is intended for firing from a smooth bore rifle.

In another embodiment of the present invention, the shroud is intended for firing from a rifled bore.

As shown in FIG. 2, the projectile device 10 also includes a wad 44 fabricated from a plastics material. The wad 44 has a base 46 of circular configuration, the base 46 defining a circumferential edge 48. A detonator 50 is located centrally on the base 46 and an upstanding cylindrical wall 52 or casing extends from the circumferential edge 48 of the base 46.

Furthermore, the upstanding wall 52, the base 46 and the insert 24 define a chamber 54 for the reception therein of explosive propellant 56, the chamber 54 being disposed adjacent to the detonator 50.

Also, the upstanding wall 52 further defines an enclosure 58 for the reception therein of the insert 24 and the shroud 16 such that the chamber 54 is disposed between the detonator 50 and the enclosure 58. The arrangement is such that when the detonator 50 is detonated, the explosive propellant 56 within the chamber 54 is ignited for propelling the combined insert 24 and shroud 16 along the flight trajectory 12 towards the target 14.

As shown in FIG. 1, the flight trajectory 12, (in the absence of any cross-wind), lies in a plane 60 extending centrally along a bore 62 of a rifle 64 and the target 14 so that during flight of the projectile device 10 towards the target 14, the restriction of the flow of air 28 by the insert 24 inhibits generation of random circumferentially located eddies 66 that could otherwise cause the shroud 16 to deviate from the plane 60 of the flight trajectory 12. Accordingly, extreme accuracy of the flight of the projectile device 10 is achieved.

Figure 8:
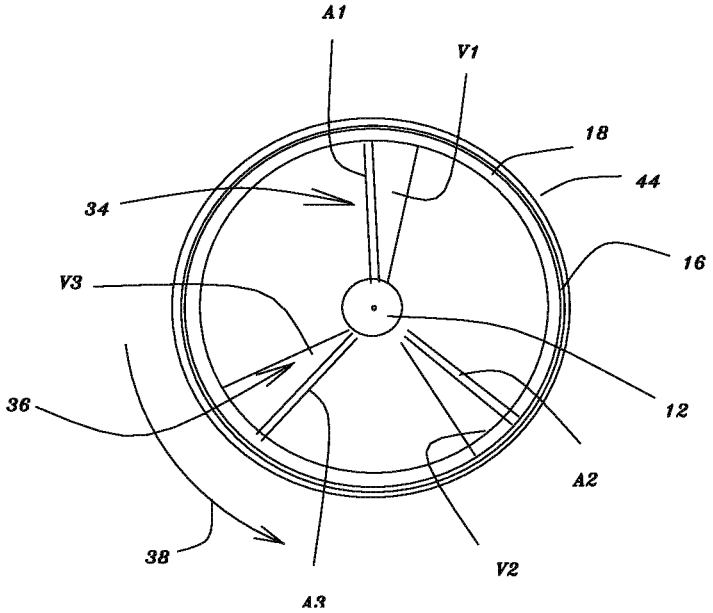
FIG. 8 is a sectional view taken on the line 8-8 of FIG. 2.

In operation of the device according to the present invention, when the projectile device 10 is fired, the upstanding wall 52 or casing will fall to the ground shortly after leaving the muzzle of the rifle. However, the shroud 16 with the insert 24 secured to the rearward end 20 thereof follows the flight trajectory 12 towards the target 14. The flow of air 28 through the channel 22 defined by the shroud 16 is inhibited by the insert 24. Consequently, the generation of any random eddies 66 within the channel 22 that would have been generated as shown in FIG. 2*b* in the absence of the insert 24 are avoided. The avoidance of such eddies 66 enables the shroud 16 to accurately follow the flight trajectory 12 resulting from the aim of the hunter when firing the projectile device 10. Also, because of the provision of the web 34 supported flighted member 36, a rotation on impact as indicated by the arrow 38 is imparted to the shroud 16 and insert 24 as shown in FIG. 8. Such rotation 38 of the shroud 16 as shown in FIG. 8 also enhances the axial rotation 38 of the shroud 16 about the flight trajectory 12 for increasing the penetration of the projectile device 10 so that it will cut through the target and the forward end 18 will cut right through the target 14.

Figure 5:
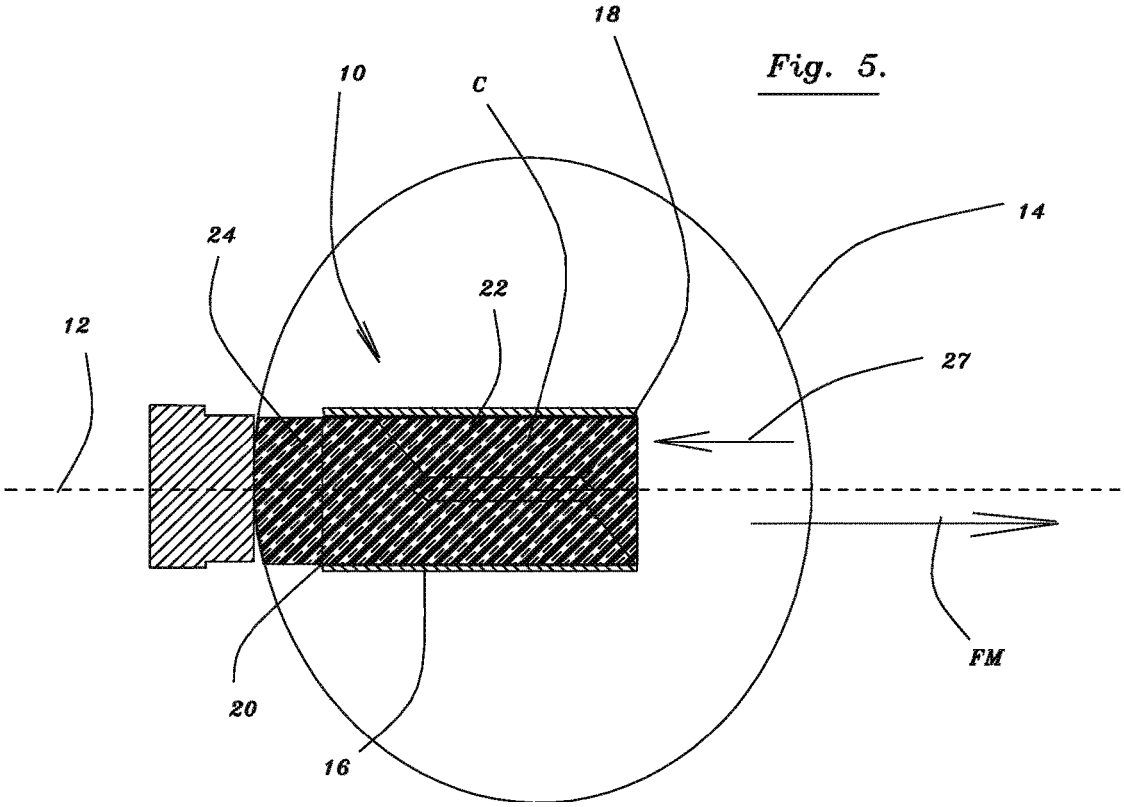
FIG. 5 is a similar view to that shown in FIG. 4 but shows further penetration of the projectile device into the target.

FIG. 5 is a similar view to that shown in FIG. 4 but shows further penetration of the projectile device 10 into the target 14. As shown in FIG. 5, on striking the target 14, the forward end 18 of the shroud 16 cuts through the target 14 so that the column C of the flesh of the target 14 on reaching the insert 24 will effectively remove or release the insert 24 from the rearward end 20 of the shroud 16.

Figure 6:
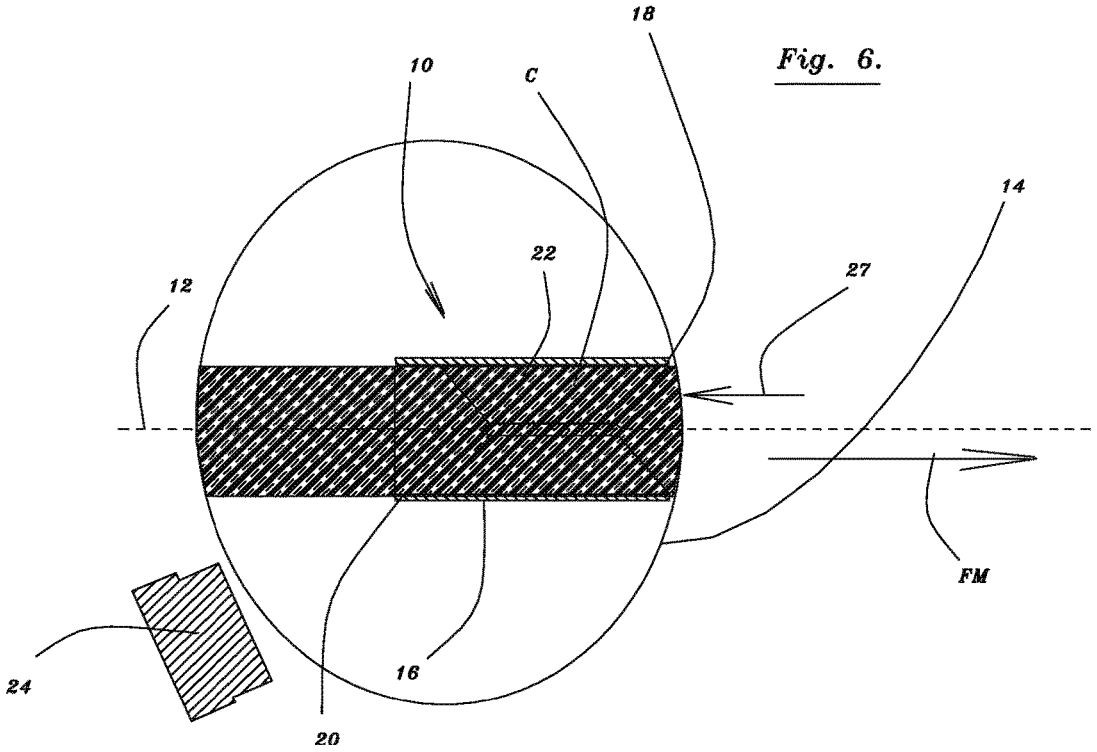
FIG. 6 is a similar view to that shown in FIG. 5 but shows the column having removed the insert from the shroud.

FIG. 6 is a similar view to that shown in FIG. 5 but shows the column C having removed the insert 24 from the shroud 16. As shown in FIG. 6, the rotation 38 of the shroud 16 on impact (as shown in FIG. 8) increases the manner in which the forward end 18 of the shroud 16 is able to cut through the target 14 and such cutting is continued as the insert 24 is released from the shroud 16. Such rotation 38 as shown in FIG. 8 and forward momentum FM of the shroud 16 enables the shroud 16 to rapidly and effectively cut through the target 14 for disabling the same.

Figure 7:
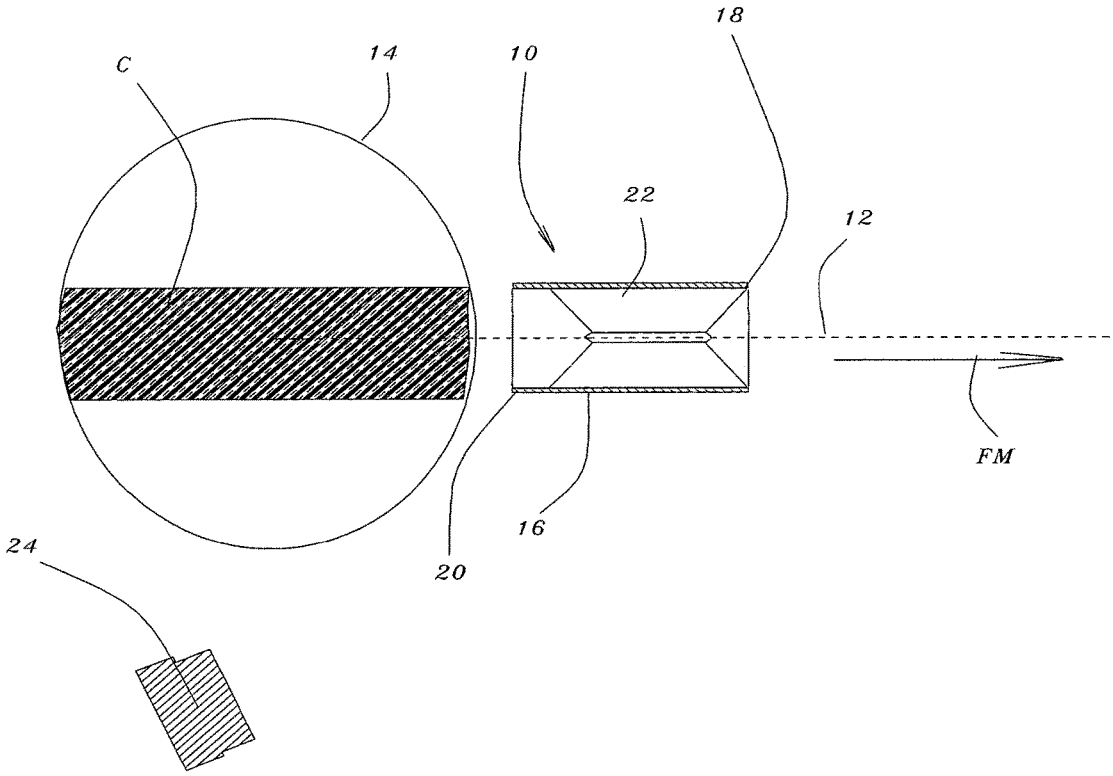
FIG. 7 is a similar view to that shown in FIG. 6 but shows the column extending through the target.

FIG. 7 is a similar view to that shown in FIG. 6 but shows the column C extending through the target 14 and the shroud 16 having made an exit from the target 14.

FIG. 8 is an enlarged sectional view taken on the line 8-8 of FIG. 2. As shown in FIG. 8, the web 34 includes three arms A1, A2 and A3 that extend radially from a central member CM and these arms A1 to A3 define the vanes or flights V1 to V3 of the flighted member 36 for securing the flighted member 36 within the shroud 16. The flighted member 36 includes flight vanes V1 to V3 that interact with the target 14 so that a spin is imparted to the shroud 16. The spin 38 of the shroud 16 augmented by the spin generated when fired from a rifled barrel increases the ability of the shroud 16 to penetrate through the target 14.

Figure 9:
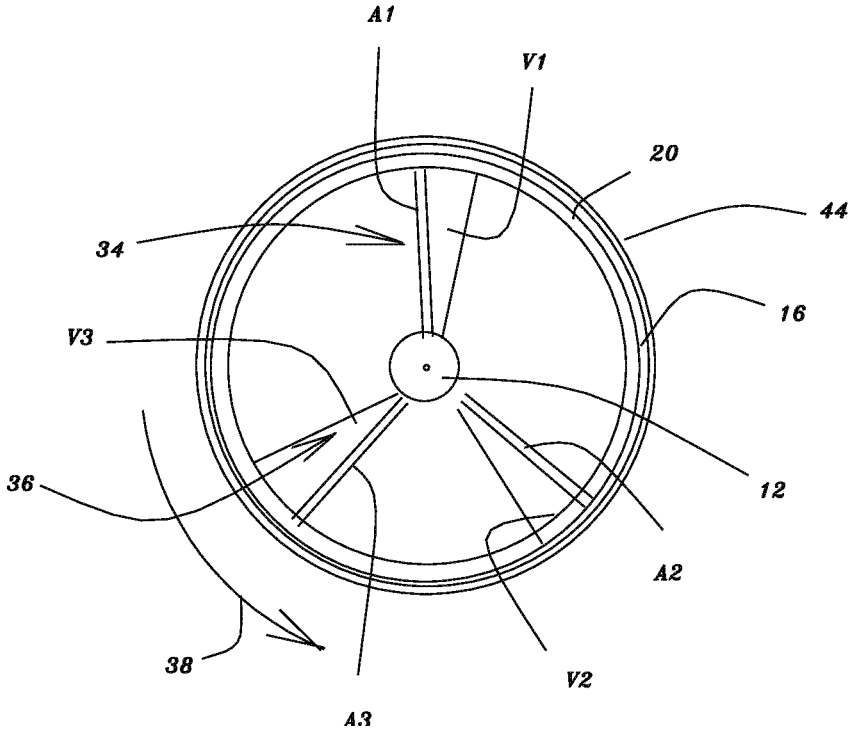
FIG. 9 is a sectional view taken on the line 9-9 of FIG. 2.

FIG. 9 is a sectional view taken on the line 9-9 of FIG. 2. As shown in FIG. 9, the rotation will be the same regardless of which way round the shroud is disposed within the wad 44.

The present invention provides a unique arrangement for increasing the penetration of a projectile device through a target.

What is claimed is:

1. A projectile device fired in a flight trajectory towards a target, said projectile device comprising:

a shroud of generally cylindrical configuration, said shroud having a forward end and a rearward end, said shroud defining a channel which extends through said shroud between said forward end and said rearward end of said shroud; and an insert releasably secured relative to said rearward end of said shroud such that during movement of the projectile device along the flight trajectory towards the target, a flow of air flowing through said forward end of said shroud through said channel is restricted by said insert for inhibiting generation of eddies that would reduce accuracy of the movement of the projectile device along the flight trajectory towards the target so that when the projectile device is fired, said shroud and said insert are secured relative to each other such that when said forward end of said shroud strikes the target, forward momentum of said shroud causes said forward end of said shroud to cut a column from said target so that the column flows through said channel from said forward end of said shroud towards said insert and when the column of the target contacts said insert, the column urges said insert to release from said rearward end of said shroud for permitting further cutting of the column by said forward end of said shroud so that the column progressively flows through said channel for increasing penetration of said shroud through the target.

2. A projectile device as set forth in claim 1 wherein said shroud is fabricated from metal.

3. A projectile device as set forth in claim 1 wherein said shroud further includes:

an internal wall defining said channel;

a web extending inwardly from said internal wall;

a flighted member rigidly secured to said web such that on impact with the target, said flighted member spins said shroud axially so that said shroud cuts through the target.

4. A projectile device as set forth in claim 3 wherein rotation of said shroud enhances cutting of the column from the target so that penetration of said shroud through said target is enhanced.

5. A projectile device as set forth in claim 1 wherein said insert is fabricated from a plastics material.

6. A projectile device as set forth in claim 5 wherein said insert includes:

a forward portion for insertion within said rearward end of said shroud for releasably securing said insert to said shroud;

a rearward portion having a diameter which is substantially the same as an outer diameter of said shroud.

7. A projectile device as set forth in claim 1 wherein said shroud is intended for firing from a smooth bore rifle.

8. A projectile device as set forth in claim 1 wherein said shroud is intended for firing from a rifled bore.

9. A projectile device as set forth in claim 1 further including:

a wad fabricated form plastics material;

said wad having a base of circular configuration, said base defining a circumferential edge;

a detonator located centrally on said base;

an upstanding wall extending from said circumferential edge of said base;

said upstanding wall, said base and said insert defining a chamber for the reception therein of explosive propellant, said chamber being adjacent to said detonator;

said upstanding wall further defining an enclosure for the reception therein of said insert and said shroud such that said chamber is disposed between said detonator and said enclosure such that when said detonator is detonated, said explosive propellant within said chamber is ignited for propelling said combined insert and shroud along said flight trajectory towards the target.

10. A projectile device as set forth in claim 1 wherein the flight trajectory, in the absence of any cross-wind, lies in a plane extending centrally along a bore of a rifle and the target so that during flight of the projectile towards the target, the restriction of the flow of air by said insert inhibits generation of random circumferentially located eddies that could otherwise cause said shroud to deviate from said plane of said flight trajectory thereby assuring extreme accuracy of the flight of the projectile towards the target is achieved.

11. A projectile device fired in a flight trajectory towards a target, said projectile device comprising:

a shroud of generally cylindrical configuration, said shroud having a forward end and a rearward end, said shroud defining a channel which extends through said shroud between said forward end and said rearward end of said shroud;

an insert releasably secured relative to said rearward end of said shroud such that during the flight trajectory towards the target, a flow of air flowing through said forward end of said shroud through said channel is restricted by said insert so that when the projectile device is fired, said shroud and said insert are secured relative to each other such that when said forward end of said shroud strikes the target, forward momentum of said shroud causes said forward end of said shroud to cut a column from said target so that the column flows through said channel from said forward end of said shroud towards said insert and when the column of the target contacts said insert, the column urges said insert to release from said rearward end of said shroud for permitting further cutting of the column by said forward end of said shroud so that the column progressively flows through said channel for increasing penetration of said shroud through the target;

said shroud further includes:

an internal wall defining said channel;

a web extending inwardly from said internal wall; and a flighted member rigidly secured to said web such that during movement of the projectile along the flight trajectory towards the target, said flighted member cooperates with the target so that said shroud rotates for increasing penetration through the target.

* * * * *